US006129087A

United States Patent [19]

Wallace et al.

[11] Patent Number: 6,129,087

[45] Date of Patent: Oct. 10, 2000

[54] REDUCED IGNITION PROPENSITY SMOKING ARTICLES

[75] Inventors: Gary W. Wallace, Macon, Ga.; Zhimin Wu, Cockeysville, Md.

[73] Assignee: Brown & Williamson Tobacco Corporation, Louisville, Ky.

[21] Appl. No.: 09/047,948

[22] Filed: Mar. 25, 1998

[51] Int. Cl.[7] ..... A24D 3/04; A24D 1/02

[52] U.S. Cl. ..... 131/339; 131/365; 131/280; 131/194

[58] Field of Search ..... 131/194, 331, 131/338, 339, 365

[56] References Cited

U.S. PATENT DOCUMENTS 675,185 5/1901 Arnold .
2,192,569 3/1940 Williams .
2,976,190 3/1961 Meyer .
3,370,593 2/1968 Owaki .
4,187,862 2/1980 Cohn .
4,243,053 1/1981 Cartwright et al. .
4,630,620 12/1986 Gabreil ..... 131/331
4,913,169 4/1990 Templeton ..... 131/194

*Primary Examiner*—Stanley S. Silverman
*Assistant Examiner*—Jacqueline A. Ruller
*Attorney, Agent, or Firm*—Middleton & Reutlinger; Charles G. Lamb

[57] ABSTRACT

A smoking article includes at least one strip of heat conducting material extending from one end of the tobacco rod of a smoking article to the opposite end of the tobacco rod. Preferably, the strip of material is at the interface between the tobacco rod and the cigarette paper and extends substantially from the lighting end of the tobacco column to at or near the attachment of a filter to the tobacco column.

7 Claims, 1 Drawing Sheet

REDUCED IGNITION PROPENSITY SMOKING ARTICLES

BACKGROUND OF THE INVENTION

This invention relates to smoking articles having a reduced ignition propensity and more particularly to a smoking article having a decrease of the temperature at the combustion zone in the tobacco column of a cigarette.

In commercially available cigarettes there is intense heat developed at the point of combustion of the tobacco which results in the production of vapors, including condensible materials, tars and the like. Thus, there has been a desire to decrease the temperature developed at the point of combustion, thereby reducing the evolution of various tars and other undesirable substances as well as the ignition propensity for cigarettes.

For example, U.S. Pat. No. 2,976,190 to Meyer teaches the coating of aluminum particles on the inner surface of cigarette wrapping paper as a means to absorb heat from the combustion zone of the cigarette and therefore reduce the overall temperature of the cigarette. U.S. Pat. No. 3,370,593 to Owaki teaches the use of spaced bands of fire proof material having high heat conductivity which surround the tobacco column and which are longitudinally spaced along the length of the cigarette as a means to reduce the heat in a tobacco column. Also, U.S. Pat. No. 4,187,862 to Cohn teaches a cigarette paper having an inner surface coated with an aqueous alkaline metal silicate solution which increases fire resistance when a lit cigarette is dropped upon mattresses, sofas, or other like pieces of furniture.

SUMMARY OF THE INVENTION

The principal object of the present invention is to provide a smoking article with reduced ignition propensity.

Another object of the present invention is to provide a smoking article which reduces the temperature in the combustion zone of a smoking article.

A further object of the present invention is to provide a smoking article which has commercial appealability and is yet relatively economical in cost.

In carrying out the objects of the present invention it has been found that with the inclusion of metallic strips having high heat conductivity, such as aluminum, copper, silver, gold, platinum, and the like, at the interface between the tobacco blend in the smoking article and the cigarette paper there is a decrease in the number of ignitions on one or more of the various weight cotton duct fabrics when tested in accordance with the primary test method proposed by NIST (1990).

Thus, the present invention provides a smoking article comprising a tobacco rod circumscribed by a cigarette wrapper with inclusion of at least one strip of a heat conducting material extending substantially the length of the tobacco rod.

Moreover, the present invention provides a method of making a smoking article comprising the steps of inserting at least one strip of heat conducting material along the length of a cigarette wrapping paper; adding tobacco to the cigarette wrapper paper; and, forming a cylindrically shaped smoking article from said tobacco and said cigarette wrapper paper.

Other objects will become apparent to those skilled in the art upon reading the detailed description of the disclosure as set forth hereinafter.

BRIEF DESCRIPTION OF THE DRAWINGS

Referring to the drawings.

DESCRIPTION OF THE PREFERRED EMBODIMENTS

Figure 1:
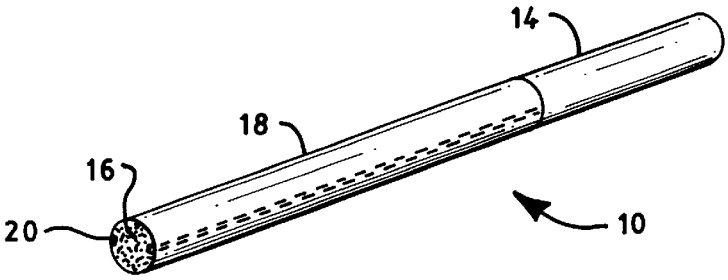
FIG. 1 is a perspective view of a preferred embodiment of the present invention.
Figure 2:
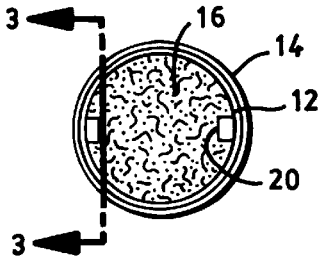
FIG. 2 is an end view of the cigarette of FIG. 1.
Figure 3:
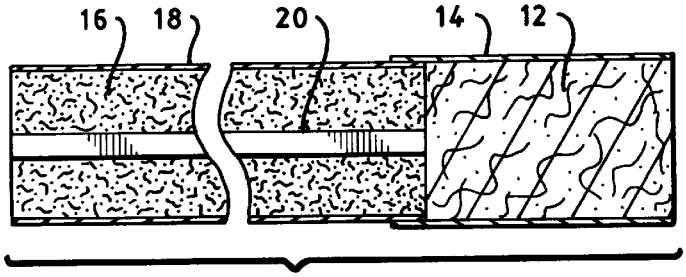
FIG. 3 is a sectional view of FIG. 2 taken along line 3—3.

In FIG. 1 is shown a smoking article of the present invention exemplified as a cigarette 10. The cigarette 10 includes a tobacco rod 16 circumscribed by a cigarette wrapping paper 18 attached to a filter 12 with tipping paper 14 attaching the filter 12 to the tobacco wrapper tobacco column 16. The cigarette 10 includes at least one longitudinally extending strip of a heat sink material 20 which extends from one end of the tobacco column 16 to the filter bundle 12. The heat sink material 20 may be any malleable conductive metal with aluminum being a preferred metal. Other heat conducting materials utilized in the present invention may include copper, tin, gold, silver, platinum, and their alloys. Moreover, the strip of the heat sink material 20, as noted, generally extends the entire length of the tobacco column and may even be visible at the lighting end as shown in the Figures. Generally, the heat conducting material will have a thickness of from about 0.0050" to about 0.0100" and a width of from about 0.030" to about 0.125" and preferably will be approximately 0.00625" in thickness and 0.070" in width. Also, as shown in the examples, each cigarette includes two heat sink strips 20 but it is realized that only one may be utilized and more than two, may also be utilized for better dissipation of the heat. However, two strips radially spaced 180° apart along the tobacco rod is preferred.

In the Figures, the heat strips 20 are located at the interface of the tobacco rod 16 and the cigarette paper 18. It is realized, however, that the heat sink strips 20 may be inserted at other locations along the tobacco column 12, but the interface with the paper 18 is the preferred location.

Figure 4:
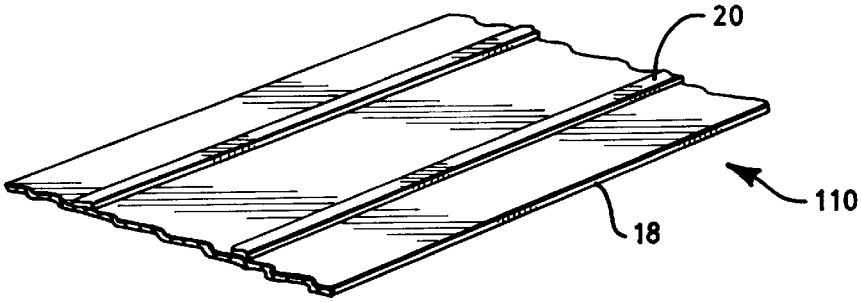
FIG. 4 is a perspective view of a cigarette wrapper paper used in the present invention; and, FIG. 5 is a schematic diagram of a preferred method of making a smoking article of the present invention.

In a preferred method of making a cigarette 10 of the present invention, as shown in FIG. 4, the heat sink strips 20 are attached to the inner surface of a cigarette wrapper paper 18 generally by any well known means, such as an appropriate commercially available adhesive. Adhering the strips of heat sink material 20 to the paper facilitates in the manufacturing of the cigarette article as set forth in the schematic diagram shown in FIG. 5.

Figure 5:
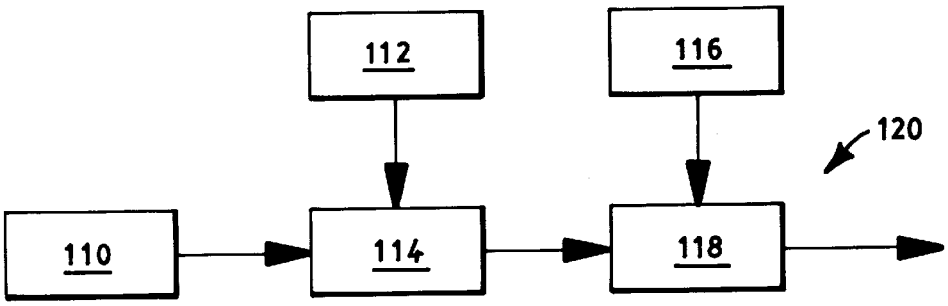

As shown in FIG. 5, at the station identified by numeral 110, a plurality of longitudinally extending heat sink strips 20 are adhered to a tobacco wrapper paper 18 which is fed to a commercially available cigarette maker 114 which receives tobacco from a tobacco hopper 112. In the cigarette maker 114, tobacco is added to the wrapper and a garniture (not shown) within the cigarette maker 114 produces a paper wrapped cylindrically-shaped tobacco column. The resulting tobacco column is then fed to a commercially available filter attaching machine 118 wherein filters 12 from a filter hopper 116 feeds the filters 12 into the machine 118 with the resulting product coming out of the filter attaching machine 118, the resulting product being a smoking article identified by the numeral 120.

It will be realized that various changes may be made to the specific embodiment shown and described without departing from the principals and spirit of the present invention as set forth in the claims appended hereto.

What is claimed is:

1. A smoking article comprising:

a tobacco rod circumscribed by a cigarette wrapper; and, at least one strip of a heat conducting material extending substantially the length of said tobacco rod, said strip of heat conducting material being disposed at the interface of said tobacco rod with said cigarette wrapper paper said strip being of rectangular configuration with a width dimension greater than a thickness dimension, said strip being attached along its width dimension to said cigarette wrapper paper.

2. The smoking article of claim 1 including two strips of heat conducting material, said strips being radially spaced approximately 180° apart.

3. The smoking article of claim 1 including a filter attached to one end of said tobacco rod.

4. The smoking article of claim 1, said strip being aluminum.

5. The smoking article of claim 1, said strip being from about 0.0050" to about 0.010" in thickness and from about 0.030" to 0.125" in width.

6. The smoking article of claim 5, said width being approximately 0.0625" and said thickness being approximately 0.0070".

7. The smoking article of claim 1 wherein said strip of heat conducting material is adhered to said cigarette wrapper paper.

* * * * *